US011298841B2

(12) United States Patent
De Haas et al.

(10) Patent No.: US 11,298,841 B2
(45) Date of Patent: Apr. 12, 2022

(54) HAIR CUTTING SYSTEM AND ATTACHMENT

(71) Applicant: KONINKLIJKE PHILIPS N.V., Eindhoven (NL)

(72) Inventors: Rogier Enrico De Haas, Hilversum (NL); Geert Willem De Goeij, Drachten (NL); Joost Tomas Glazenburg, Groningen (NL); Anke Gerda Sinnema, Opeinde (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 104 days.

(21) Appl. No.: 16/614,828

(22) PCT Filed: Jun. 5, 2018

(86) PCT No.: PCT/EP2018/064671

§ 371 (c)(1),
(2) Date: Nov. 19, 2019

(87) PCT Pub. No.: WO2018/228850

PCT Pub. Date: Dec. 20, 2018

(65) Prior Publication Data

US 2020/0086515 A1 Mar. 19, 2020

(30) Foreign Application Priority Data

Jun. 14, 2017 (EP) ..... 17175974

(51) Int. Cl.
*B26B 19/38* (2006.01)
*B26B 19/06* (2006.01)
*B26B 19/20* (2006.01)

(52) U.S. Cl.
CPC ..... *B26B 19/3813* (2013.01); *B26B 19/06* (2013.01); *B26B 19/20* (2013.01)

(58) Field of Classification Search
CPC ..... B26B 19/3813; B26B 19/06; B26B 19/20; B26B 19/38
(Continued)

(56) References Cited

U.S. PATENT DOCUMENTS 2,102,529 A * 12/1937 Hanley ..... B26B 19/042 30/43.92
2,470,594 A 5/1949 Roy
(Continued)

FOREIGN PATENT DOCUMENTS

GB 2402645 12/2004
WO 2013/150412 10/2013
(Continued)

OTHER PUBLICATIONS

International Search Report and Written Opinion dated Sep. 6, 2018 For International Application No. PCT/EP2018/064671.

*Primary Examiner* — Nhat Chieu Q Do

(57) ABSTRACT

There is disclosed an attachment (22) for a cutting head (100) of a hair cutting device (1). The attachment (22) comprises first and second side portions (24, 26) configured to cover, respectively, first and second sides (112, 114) of a stationary cutting member (115) of the cutting head (100), and an intermediate portion (28) interconnecting the first and second side portions (24, 26) and configured to cover an outer surface (120*b*) of a first wall portion (120) of the stationary cutting member (115). The first and second side portions (24, 26) are configured to protrude relative to the plurality of primary cutter teeth (118) of the stationary cutting member (115), which define a cutting zone of the cutting head. The first and second side portions (24, 26) and the intermediate portion (28) define a recess exposing the primary cutter teeth (118) of the stationary cutting member
(Continued)

(115). The recess is non-interrupted over a distance of at least 50% of the length of the cutting zone.

17 Claims, 5 Drawing Sheets

(58) Field of Classification Search
USPC ..... 30/43.4, 43.5, 43.91, 43.92; D8/98
See application file for complete search history.

(56) References Cited

U.S. PATENT DOCUMENTS

| | | | | |
|---|---|---|---|---|
| 4,512,077 | A * | 4/1985 | Tanabe | B26B 19/06 30/41 |
| 6,058,608 | A | 5/2000 | Wruck | |
| 6,185,823 | B1 | 2/2001 | Brown | |
| 7,051,442 | B2 * | 5/2006 | McCambridge | B26B 19/20 30/233 |
| 10,906,196 | B2 * | 2/2021 | Hahn | B26B 21/18 |
| 2014/0317932 | A1 | 10/2014 | Van Straaten | |
| 2015/0047203 | A1 * | 2/2015 | Stapelbroek | B26B 19/3846 30/43.6 |
| 2016/0271814 | A1 | 9/2016 | Bennik | |
| 2017/0190063 | A1 * | 7/2017 | Schratter | B26B 19/042 |
| 2018/0085945 | A1 * | 3/2018 | Bady | B26B 19/143 |
| 2018/0085946 | A1 * | 3/2018 | Bady | B26B 19/205 |

FOREIGN PATENT DOCUMENTS

| | | |
|---|---|---|
| WO | 2015/075159 | 5/2015 |
| WO | 2015/158572 | 10/2015 |

* cited by examiner

B-B

HAIR CUTTING SYSTEM AND ATTACHMENT

This application is the U.S. National Phase application under 35 U.S.C. § 371 of International Application No. PCT/EP2018/064671 filed Jun. 5, 2018, published as WO 2018/228850 on Dec. 20, 2018, which claims the benefit of European Patent Application Number 17175974.9 filed Jun. 14, 2017. These applications are hereby incorporated by reference herein.

FIELD OF THE INVENTION

This invention relates generally to a hair cutting system comprising a cutting head and an attachment which is releasably connectable to the cutting head.

BACKGROUND

Electric hair cutting devices are widely used to cut body hair and typically include a handle and a cutting head. Cutting heads with reciprocating cutters are known, which comprise a stationary outer cutting member and a movable inner cutting member which reciprocates with respect to the outer cutting member so as to perform a cutting operation. In some arrangements the outer cutting member may be provided with a plurality of cutter teeth provided arranged in a row, and the inner cutting member may also comprise a plurality of cutter teeth arranged in a row for cooperation with the cutter teeth of the outer cutting member. In use, the cutter teeth may come into direct contact with the user's skin. This may result in discomfort and/or skin irritation.

Further, in order to aid manoeuvrability of the cutting head over the user's skin, the depth (in a direction perpendicular to the movement axis of the reciprocating cutter) of the cutting head is typically relatively small. This small depth can cause problems when the cutting head is designed to pivot or swivel relative to the handle to follow the contours of the skin. The user will need to apply force to the cutting head in order to pivot the cutting head about the pivot axis. With a relatively small depth of the cutting head the applied force may push the cutting head deeper into the skin. The skin may then be caused to bunch or dome in the areas around the cutter teeth. This may be especially a problem in sensitive or softer areas of the skin. There is therefore an increased risk of skin abrasion, skin cuts, pain, reduced hair cutting performance and skin irritation.

WO 2015/075159 discloses such a hair cutting device. This device has two parallel rows of cutter teeth provided on opposite main sides of the stationary cutting member of the cutting head. The depth of the cutting head, i.e. the distance between the two parallel rows of cutter teeth, is relatively small. It is described that the stationary cutting member of the cutting head is provided with side protection elements to reduce skin irritation. However, the side protection elements may not prevent skin doming during use, and therefore the cutter teeth may still cause skin irritation during use.

U.S. Pat. No. 2,470,594 A discloses a tapering clip for a hair clipper. The clip comprises a body member of sheet material and a pair of parallel spaced hook members integral with the body member and extending each from the same end of the body member. A forward portion of the body member is bent to function as a tapering clip for the hair clipper. Said hook members may be slidably hooked over a forward end of the hair clipper, whereby side flanges integrally provided on the body member will resiliently clamp against adjacent sides of the hair clipper to hold the tapering clip in an operative position on the hair clipper.

WO 2013/150412 A1 discloses a stationary blade for a blade set of an electrically operated hair cutting appliance. The stationary blade has a first wall and a second wall, each wall defining a first surface, a second surface facing away from the first surface, and a laterally extending leading edge defining a plurality of laterally spaced apart longitudinally extending projections. The first surfaces of the first and second walls face each other, at least at their leading edges, while facing projections along the leading edges of the first and second walls are mutually connected at their tips to define a plurality of generally U-shaped teeth. The first surfaces of the first and second walls define a laterally extending guide slot for a movable blade of said blade set between them.

It may therefore be desirable to provide an improved hair cutting system which may provide a more comfortable hair cutting operation without reducing the hair cutting performance.

SUMMARY

According to a first aspect of the invention, there is provided a hair cutting system comprising a cutting head and an attachment which is releasably connectable to the cutting head, wherein the cutting head comprises a stationary cutting member comprising a first wall portion and a second wall portion, which are mutually connected by means of a bent intermediate wall portion wherein a plurality of primary cutter teeth having a bent cross-section is provided, and a movable cutting member which is moveable in a reciprocating manner along a cutter axis in a guiding space enclosed by the first and second wall portions of the stationary cutting member and which comprises a plurality of secondary cutter teeth for co-operation with the primary cutter teeth; wherein the first wall portion and the second wall portion each have an inner surface and an outer surface, wherein the inner surfaces of the first and second wall portions face each other, and wherein the outer surface of the first wall portion is part of a skin facing surface of the cutting head which faces a user's skin during operation; wherein the plurality of primary cutter teeth define a cutting zone of the cutting head extending parallel to the cutter axis and having a length; and wherein the stationary cutting member has opposite first and second sides spaced apart in a direction parallel to the cutter axis; the attachment comprising first and second side portions configured to cover, respectively, the first and second sides of the stationary cutting member when the attachment is connected to the cutting head, and an intermediate portion interconnecting the first and second side portions of the attachment and configured to cover the outer surface of the first wall portion when the attachment is connected to the cutting head; wherein, when the attachment is connected to the cutting head, the first and second side portions of the attachment protrude relative to the primary cutter teeth in a direction perpendicular to the cutter axis and parallel to the first wall portion; and the first and second side portions of the attachment and the intermediate portion define a recess of the attachment exposing the primary cutter teeth, the recess extending in a direction parallel to the cutter axis and being non-interrupted in said direction parallel to the cutter axis over a distance of at least 50% of the length of the cutting zone; and wherein the first and second side portions of the attachment each have a convex outer surface, seen in a cross-section parallel to the first wall portion when the attachment is connected to the cutting head.

The recess of the attachment may be non-interrupted in said direction parallel to the cutter axis over a distance of at least 50%, at least 60%, at least 70%, at least 75%, at least 80%, at least 85%, at least 90% or at least 95% of the length of the cutting zone.

The attachment may be toothless. There may be no teeth or comb teeth extending or overlapping the primary cutter teeth. The intermediate element may comprise a substantially continuous outer surface arranged for contact with a user's skin.

In an embodiment of the hair cutting system according to the invention, the recess of the attachment is bounded by a continuous longitudinal edge of the intermediate portion which, when the attachment is connected to the cutting head, extends in a direction parallel to the cutter axis. When the attachment is connected to the cutting head, the continuous longitudinal edge may be arranged over the primary cutter teeth, such that only parts of the primary cutter teeth are exposed. Alternatively the continuous longitudinal edge may be arranged over the outer surface of the first wall portion, such that the primary cutter teeth are fully exposed.

In a further embodiment of the hair cutting system according to the invention, the intermediate portion comprises an elongate wall which, when the attachment is connected to the cutting head, extends in a direction parallel to the cutter axis and has a convex outer surface seen in a cross-section perpendicular to the cutter axis. The intermediate portion may be configured such that, when the attachment is connected to the cutting head, the convex outer surface is spaced from the outer surface of the first wall portion of the stationary cutting member in a direction perpendicular to the first wall portion. The intermediate portion may be configured such that, when the attachment is connected to the cutting head, the convex outer surface is spaced from the outer surface of the first wall portion by a maximum distance of between 0.2 to 4 mm. The convex outer surface of the elongate wall may have a radius of curvature of between 10 mm and 50 mm in said cross-section perpendicular to the cutter axis.

In a particular embodiment of the hair cutting system according to the invention, when the attachment is connected to the cutting head, the first and second side portions of the attachment protrude relative to the primary cutter teeth in the direction perpendicular to the cutter axis and parallel to the first wall portion by a distance of between 0.5 mm and 3 mm.

In a further embodiment of the hair cutting system according to the invention, the convex outer surfaces of the first and second side portions of the attachment each have a radius of curvature in said cross-section parallel to the first wall portion which is between 0.5 and 2 times a length of the respective side portion in a direction perpendicular to the cutter axis and parallel to the first wall portion.

In a yet further embodiment of the hair cutting system according to the invention, the first and second side portions of the attachment each have a convex outer surface, seen in a cross-section perpendicular to the first wall portion and parallel to the cutter axis when the attachment is connected to the cutting head. The convex outer surfaces of the first and second side portions may each have a radius of curvature in said cross-section perpendicular to the first wall portion and parallel to the cutter axis which is between 1 mm and 5 mm.

In a preferred embodiment of the hair cutting system according to the invention, the stationary cutting member comprises a third wall portion and a fourth wall portion, which are mutually connected by means of a bent further intermediate wall portion wherein a plurality of further primary cutter teeth having a bent cross-section is provided, wherein the plurality of primary cutter teeth and the plurality of further primary cutter teeth are respectively provided on opposite third and fourth sides of the stationary cutting member spaced apart in a direction perpendicular to the cutter axis; the guiding space is further enclosed by the third and fourth wall portions; the movable cutting member comprises a plurality of further secondary cutter teeth for co-operation with the further primary cutter teeth; the third wall portion and the fourth wall portion each have an inner surface and an outer surface, wherein the inner surfaces of the third and fourth wall portions face each other, and wherein the outer surface of the third wall portion is part of the skin facing surface of the cutting head; the plurality of further primary cutter teeth define a further cutting zone of the cutting head extending parallel to the cutter axis and having a length; and the intermediate portion of the attachment is configured to cover the outer surface of the third wall portion when the attachment is connected to the cutting head; and wherein, when the attachment is connected to the cutting head the first and second side portions of the attachment protrude relative to the further primary cutter teeth in a direction perpendicular to the cutter axis and parallel to the third wall portion; and the first and second side portions of the attachment and the intermediate portion define a further recess of the attachment exposing the further primary cutter teeth, the further recess extending in a direction parallel to the cutter axis and being non-interrupted in said direction parallel to the cutter axis over a distance of at least 50% of the length of the further cutting zone.

In said preferred embodiment, the recess and further recess of the attachment may be non-interrupted in said direction parallel to the cutter axis over a distance of at least 50%, at least 60%, at least 70%, at least 75%, at least 80%, at least 85%, at least 90% or at least 95% of the length of, respectively, the cutting zone and the further cutting zone.

In a further embodiment of the hair cutting system according to the invention, the further recess of the attachment is bounded by a further continuous longitudinal edge of the intermediate portion which extends parallel to the continuous longitudinal edge which bounds the recess. When the attachment is connected to the cutting head, the further continuous longitudinal edge may be arranged over the further primary cutter teeth, such that only parts of the further primary cutter teeth are exposed. Alternatively the further continuous longitudinal edge may be arranged over the outer surface of the third wall portion, such that the further primary cutter teeth are fully exposed.

In a further embodiment of the hair cutting system according to the invention, when the attachment is connected to the cutting head, the first and second side portions of the attachment protrude relative to the primary cutter teeth by a first distance and protrude relative to the further primary cutter teeth by a second distance different to the first distance.

In a preferred embodiment of a hair cutting system according to the invention, the attachment is connectable to the cutting head by means of a releasable snap-on connector.

According to a second aspect of the invention, there is provided an attachment which is releasably connectable to a cutting head of a hair cutting device, for use in any embodiment of a hair cutting system in accordance with the invention as described herein. According to the second aspect, there is thus provided an attachment which is releasably connectable to a cutting head of a hair cutting device, the cutting head comprising a stationary cutting member comprising a first wall portion and a second wall portion, which are mutually connected by means of a bent intermediate wall portion wherein a plurality of primary cutter teeth having a bent cross-section is provided, and a movable cutting member which is moveable in a reciprocating manner along a cutter axis in a guiding space enclosed by the first and second wall portions of the stationary cutting member and which comprises a plurality of secondary cutter teeth for co-operation with the primary cutter teeth; wherein the first wall portion and the second wall portion each have an inner surface and an outer surface, wherein the inner surfaces of the first and second wall portions face each other, and wherein the outer surface of the first wall portion is part of a skin facing surface of the cutting head which faces a user's skin during operation; wherein the plurality of primary cutter teeth define a cutting zone of the cutting head extending parallel to the cutter axis and having a length; and wherein the stationary cutting member has opposite first and second sides spaced apart in a direction parallel to the cutter axis; the attachment comprising first and second side portions configured to cover, respectively, the first and second sides of the stationary cutting member when the attachment is connected to the cutting head; and an intermediate portion interconnecting the first and second side portions of the attachment and configured to cover the outer surface of the first wall portion when the attachment is connected to the cutting head; wherein, when the attachment is connected to the cutting head, the first and second side portions of the attachment protrude relative to the primary cutter teeth in a direction perpendicular to the cutter axis and parallel to the first wall portion; and the first and second side portions of the attachment and the intermediate portion define a recess of the attachment exposing the primary cutter teeth, the recess extending in a direction parallel to the cutter axis and being non-interrupted in said direction parallel to the cutter axis over a distance of at least 50% of the length of the cutting zone; and wherein the first and second side portions of the attachment each have a convex outer surface, seen in a cross-section parallel to the first wall portion when the attachment is connected to the cutting head.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION

Figure 1:
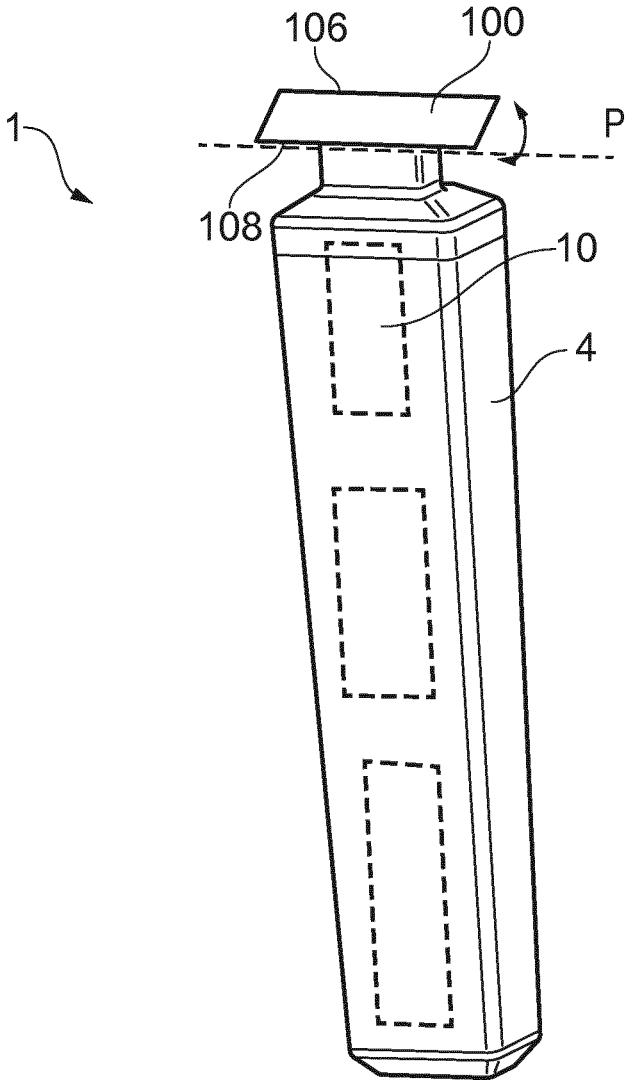
FIG. 1 schematically shows a hair cutting device which is part of a hair cutting system according to the invention.

FIG. 1 generally shows a hair cutting device 1 which is part of a hair cutting system according to the invention. The hair cutting device 1 is an electric shaving or trimming device comprising a cutting head 100 attached to a handle 4. In this arrangement the cutting head 100 is pivotable about a pivot axis P with respect to the handle 4. As will be described in detail below, the cutting head 100 comprises a first cutting zone 106 and a second cutting zone 108 which are elongate and generally parallel to one another.

Figure 2:
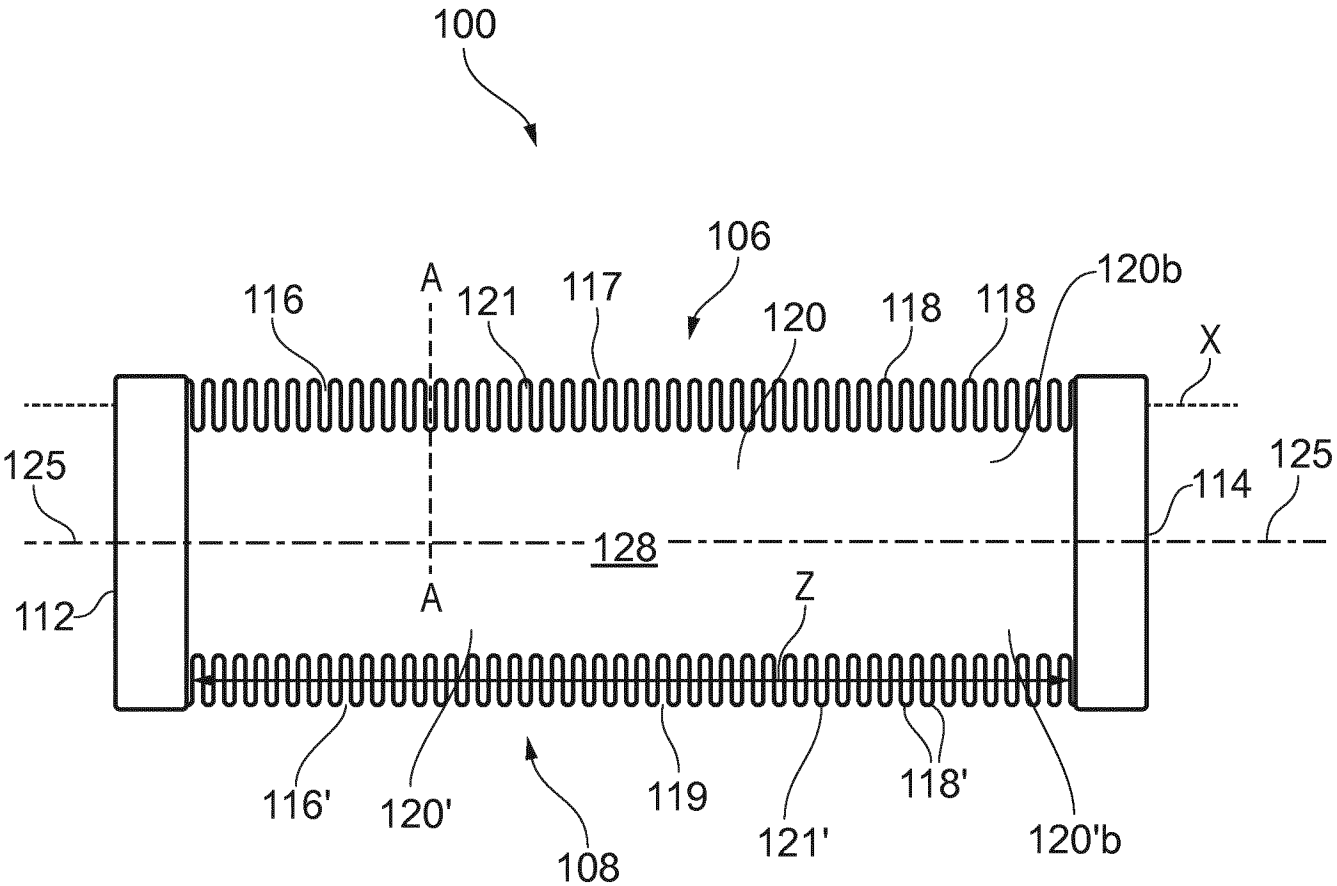
FIG. 2 schematically shows a cutting head of the hair cutting device of FIG. 1.
Figure 3:
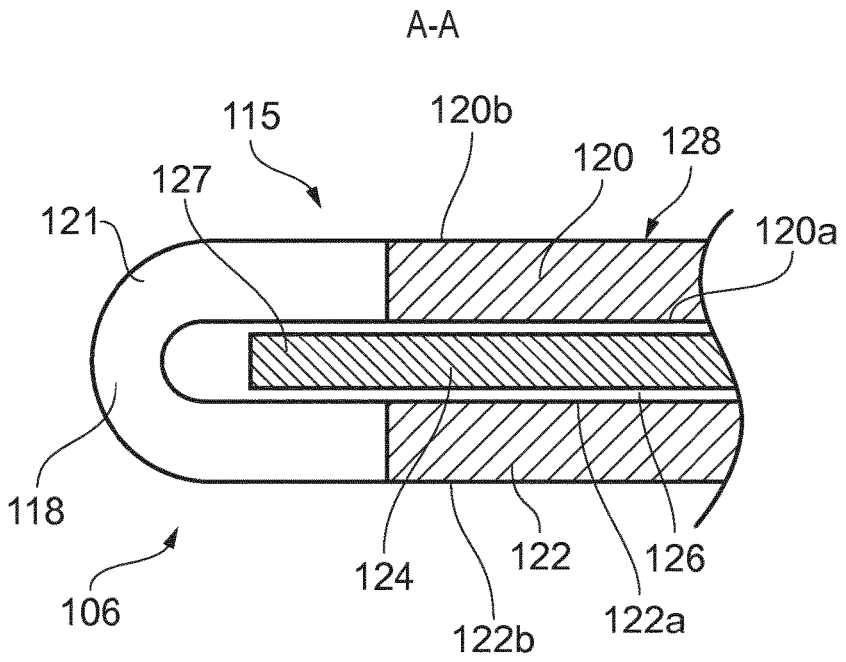
FIG. 3 schematically shows a cross-sectional view of the cutting head of FIG. 2 along the line A-A in FIG. 2.

Referring now to FIG. 2 and FIG. 3, which shows only the first cutting zone 106 of the cutting head 100 in cross-sectional view, the cutting head 100 comprises a stationary outer cutting member 115 and a movable inner cutting member 124 which is moveable in a reciprocating manner along a cutter axis 125 in a guiding space 126 of the stationary cutting member 115. The movable cutting member 124 is arranged to be driven by a motor 10 provided in the handle 4. The cutter axis 125 is parallel to the pivot axis P. The stationary cutting member 115 has opposite first and second sides 112, 114 which are spaced apart in a direction parallel to the cutter axis 125 and which are generally parallel to one another. The stationary cutting member 115 further has opposite third and fourth sides 117, 119 spaced apart in a direction perpendicular to the cutter axis 125. The first and second cutting zones 106, 108 are respectively located on said opposite third and fourth sides 117, 119 of the stationary cutting member 115.

At the location of the first cutting zone 106, the stationary cutting member 115 comprises a first upper wall portion 120 and a second lower wall portion 122 that are generally planar and parallel to one another in this embodiment. The first and second wall portions 120, 122 are mutually connected by means of a bent first intermediate wall portion 121 wherein a plurality of first primary cutter teeth 118 is provided. The first and second wall portions 120, 122 and the first intermediate wall portion 121 may be manufactured from a single metal sheet by a suitable bending process. In this embodiment, the first primary cutter teeth 118 each have a bent U-shaped cross-section in a plane perpendicular to the cutter axis 125. The first primary cutter teeth 118 are spaced apart in a direction parallel to the cutter axis 125 so as to define hair-entry openings 116 there between. The first wall portion 120 and the second wall portion 122 each have an inner surface 120*a*, 122*a* and an outer surface 120*b*, 122*b*. The inner surfaces 120*a*, 122*a* face each other. The outer surface 120*b* of the first wall portion 120 is part of a skin facing surface 128 of the cutting head 100 which is arranged to face or to contact a user's skin during operation.

Likewise, at the location of the second cutting zone 108 the stationary cutting member 115 comprises a third upper wall portion 120' and a fourth lower wall portion that are generally planar and parallel to one another in this embodiment. In FIG. 2 only the third wall portion 120' is visible, while in FIG. 3 the third and fourth wall portions are not visible. The third wall portion 120' and the fourth wall portion are mutually connected by means of a bent second intermediate wall portion 121', as shown in FIG. 2, wherein a plurality of second primary cutter teeth 118' is provided. The third and fourth wall portions and the second intermediate wall portion 121' may be manufactured from a single metal sheet, together with the first and second wall portions 120, 122, by a suitable bending process. In this embodiment, the second primary cutter teeth 118' each have a bent U-shaped cross-section in a plane perpendicular to the cutter axis 125. The second primary cutter teeth 118' are spaced apart in a direction parallel to the cutter axis 125 so as to define hair-entry openings 116' there between. The third wall portion 120' and the fourth wall portion each have an inner surface and an outer surface. In FIG. 2 only the outer surface 120'*b* of the third wall portion 120' is visible. The inner surfaces of the third and fourth wall portions face each other.

The outer surface 120'*b* of the third wall portion 120' is part of the skin facing surface 128 of the cutting head 100.

Thus, the plurality of first primary cutter teeth 118 is provided on the third side 117 of the stationary cutting member 115 and defines the first cutting zone 106 of the cutting head 100, which extends parallel to the cutter axis 125. The plurality of second primary cutter teeth 118' is provided on the fourth side 119 of the stationary cutting member 115 and defines the second cutting zone 108 of the cutting head 100, which extends parallel to the cutter axis 125.

The guiding space 126 for the movable cutting member 124 is defined and enclosed by the first, second, third and fourth wall portions 120, 122, 120' of the stationary cutting member 115. The movable cutting member 124 comprises a plate-shaped carrier which, in this embodiment, extends generally parallel to the first, second, third and fourth wall portions 120, 122, 120' of the stationary cutting member 115. The carrier is provided with a plurality of first secondary cutter teeth 127 (not shown in detail) that are arranged to cooperate with the first primary cutter teeth 118 of the stationary cutting member 115 to perform a hair-cutting operation at the first cutting zone 106 of the cutting head 100. Likewise, the carrier is provided with a plurality of second secondary cutter teeth (not shown in detail) that are arranged to cooperate with the second primary cutter teeth 118' of the stationary cutting member 115 to perform a hair-cutting operation at the second cutting zone 108 of the cutting head 100. Seen in the cross-sectional view of FIG. 3, the first secondary cutter teeth 127 are arranged within and enclosed by the bent first intermediate wall portion 121 of the stationary cutting member 115. Likewise, the second secondary cutter teeth are arranged within and enclosed by the bent second intermediate wall portion 121' of the stationary cutting member 115.

During use, hair enters the first and second cutting zones 106, 108 via the hair-entry openings 116 between the first primary cutter teeth 118 and via the hair-entry openings 116' between the second primary cutter teeth 118'. The stationary first primary cutter teeth 118 and the reciprocating first secondary cutter teeth cooperate to perform a cutting action over the first cutting zone 106, and the stationary second primary cutter teeth 118' and the reciprocating second secondary cutter teeth cooperate to perform a cutting action over the second cutting zone 108. The cutting actions may generally take place in a cutting plane parallel to the plane of the carrier of the moveable cutting member 124. The first and second cutting zones 106, 108 are longitudinally extending in a direction parallel to the cutter axis 125 and may be defined as the continuous region or area over which cutting takes place. Opposite first and second ends of the first and second cutting zones 106, 108 may be defined at the outermost positions of the first and second cutting zones 106, 108 at which cutting can take place. In other words, the first and second cutting zones 106, 108 are the entire areas within which cutting can take place, rather than being a sub-area or region of a larger cutting area or zone. A length Z of the first and second cutting zones 106, 108 may thus be defined as a distance between said opposite first and second ends of the first and second cutting zones 106, 108. In the embodiment shown in the figures, the first and second cutting zones 106, 108 have equal lengths Z.

Figure 4:
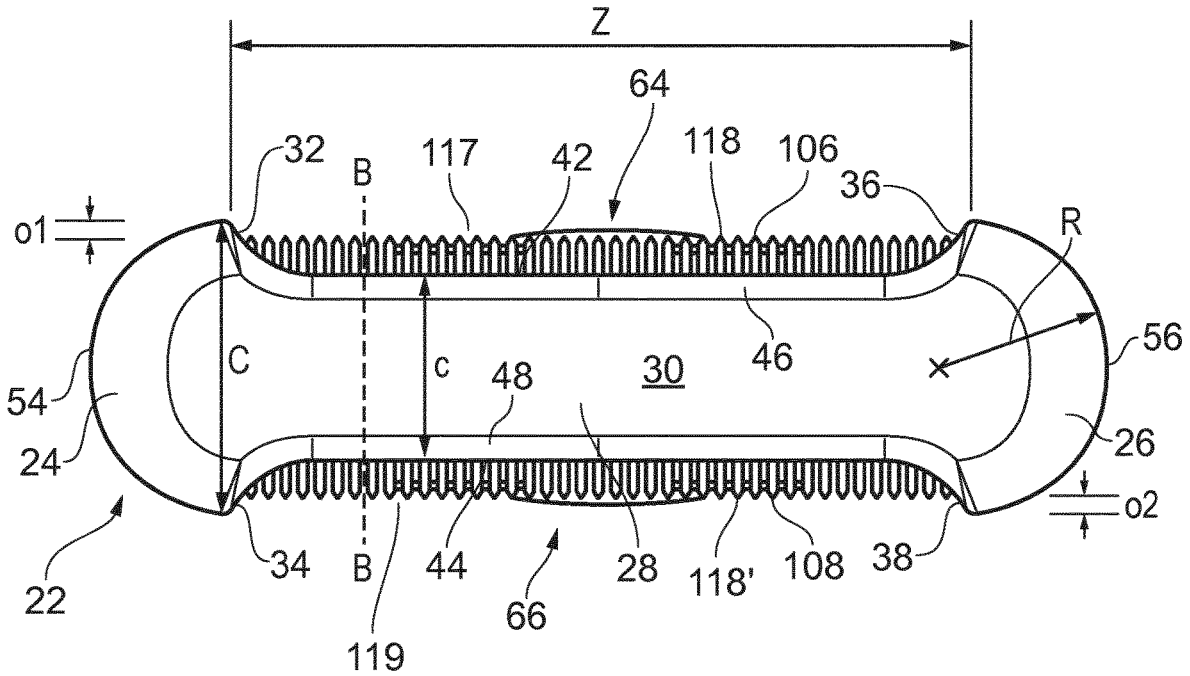
FIG. 4 schematically shows the cutting head of FIG. 2 with an attachment according to the invention attached to the cutting head.

FIG. 4 shows an attachment 22, in this embodiment having the form of a blade guard, attached to the cutting head 100 in order to increase the comfort of the user of the hair cutting device 1 when moving the cutting head 100 over the skin. The attachment 22 is part of the hair cutting system according to the invention and is releasably connectable to the cutting head 100. In other words, the user may connect the attachment 22 to the cutting head 100 and may remove the attachment 22 from the cutting head 100 in order to use the hair cutting device 1 either with or without the attachment 22 connected to the cutting head 100. FIG. 4 shows the attachment 22 in a condition connected to the cutting head 100.

The attachment 22 comprises first and second side portions 24, 26 which are configured to cover, respectively, the first and second sides 112, 114 of the stationary cutting member 115 of the cutting head 100 when the attachment 22 is connected to the cutting head 100. The attachment 22 further comprises an intermediate portion 28 which interconnects the first and second side portions 24, 26 of the attachment 22. The intermediate portion 28 is elongate and extends in a direction substantially parallel to the cutter axis 125 when the attachment 22 is connected to the cutting head 100. The intermediate portion 28 is configured to cover the outer surface 120*b* of the first wall portion 120 of the stationary cutting member 115 and the outer surface 120'*b* of the third wall portion 120' of the stationary cutting member 115 when the attachment 22 is connected to the cutting head 100. Thus the attachment 22 generally overlies the skin facing surface 128 of the cutting head 100 when the attachment 22 is connected to the cutting head 100. The attachment 22 comprises a top surface 30 which is arranged to contact the user's skin during use. In this embodiment, the attachment 22 is generally symmetric about a first central plane perpendicular to the cutter axis 125, and about a second central plane perpendicular to first wall portion 120 and parallel to the cutter axis 125.

The first side portion 24 and the second side portion 26 respectively cover the first and second sides 112, 114 of the stationary cutting member 115. When the attachment 22 is connected to the cutting head 100, the first side portion 24 and the second side portion 26 each protrude relative to the first primary cutter teeth 118 in a direction perpendicular to the cutter axis 125 and parallel to the first wall portion 120. Likewise, when the attachment 22 is connected to the cutting head 100, the first side portion 24 and the second side portion 26 each protrude relative to the second primary cutter teeth 118' in a direction perpendicular to the cutter axis 125 and parallel to the third wall portion 120'. More particularly, the first and second side portions 24, 26 extend beyond the first primary cutter teeth 118 by a distance o1 and extend beyond the second primary cutter teeth 118' by a distance o2, as shown in FIG. 4. The distances o1 and o2 may be equal, or different distances o1 and o2 may be selected. In an example, the distances of and o2 may be between 0.2 mm and 3 mm, such as 0.8 mm.

The first and second side portions 24, 26 of the attachment 22 prevent the edges of the first and second sides 112, 114 of the stationary cutting member 115 from coming into contact with the user's skin and may therefore provide a more comfortable user experience. The protruding first and second side portions 24, 26 of the attachment 22 also reduce the pressure exerted by the first and second primary cutter teeth 118, 118' on the user's skin. This is particularly the case when the cutting head 100 is pivoted about the pivot axis P to enable the cutting head 100 to follow local skin contours. A pivoting motion of the cutting head 100 about the pivot axis P results from a mechanical torque about the pivot axis P exerted by the skin on the cutting head 100. In a condition without the attachment 22 being connected to the cutting head 100, said mechanical torque mainly results from skin contact forces exerted on the primary cutter teeth 118, 118'.

Because the distance (in a direction perpendicular to the cutter axis 125 and parallel to the first wall portion 120) between the tips of the first and second primary cutter teeth 118, 118' (i.e. the so-called "depth" of the cutting head 100) is relatively small, such skin contact forces exerted on the primary cutter teeth 118, 118' necessary for pivoting the cutting head 100 may be relatively large and may result in irritation, cuts, and/or abrasion of the skin. In a condition with the attachment 22 being connected to the cutting head 100, said mechanical torque results from or is at least increased by skin contact forces exerted on the parts of the first and second side portions 24, 26 of the attachment 22 protruding relative to the primary cutter teeth 118, 118'. Since the depth C (in a direction perpendicular to the cutter axis 125 and parallel to the first wall portion 120) of the side portions 24, 26 as shown in FIG. 4 is greater than the depth of the cutting head 100 as described here before, the skin contact forces exerted on the first and second side portions 24, 26 result in a more effective mechanical torque about the pivot axis P and thereby strongly reduce the skin contact forces exerted on the primary cutter teeth 118, 118' and strongly increase skin comfort. As a result, when the user applies force to the cutting head 100, this force is distributed over a wider skin contacting area, which acts to reduce the application pressure. In an example wherein said depth of the cutting head 100 is in a range between 5 mm and 11 mm, the depth C of the side portions 24, 26 of the attachment 22 may be between 8 mm and 14 mm, e.g. 12.6 mm.

The first side portion 24 of the attachment 22 comprises first and second inner wall portions 32, 34 which, when the attachment 22 is connected to the cutting head 100, are located near respectively the opposite third and fourth sides 117, 119 of the stationary cutting member 115 and respectively face the first and second cutting zones 106, 108 of the cutting head 100. Similarly, the second side portion 26 of the attachment 22 comprises first and second inner wall portions 36, 38 which, when the attachment 22 is connected to the cutting head 100, are located near respectively the opposite third and fourth sides 117, 119 of the stationary cutting member 115 and respectively face the first and second cutting zones 106, 108 of the cutting head 100. The pair of said first inner wall portions 32, 36 diverges in a plane parallel to the first wall portion 120 of the stationary cutting member 115, and the pair of said second inner wall portions 34, 38 diverges in a plane parallel to the third wall portion 120' of the stationary cutting member 115. The diverging pairs of first and second inner wall portions 32, 36, 34, 38 may help to stretch the skin in a direction parallel to the cutter axis 125 during use. This may improve the hair removal process and may reduce the likelihood of skin damage.

The first and second side portions 24, 26 of the attachment 22 each have a convex outer surface 54, 56, seen in a cross-sectional plane parallel to the first wall portion 120 when the attachment 22 is connected to the cutting head 100. In the embodiment shown in FIG. 4, the convex outer surfaces 54, 56 of the first and second side portions 24, 26 have a generally semi-circular shape. The radius of curvature R of said convex outer surfaces 54, 56 in said cross-sectional plane parallel to the first wall portion 120 may be between 0.5 and 2 times the depth C of the first and second side portions 24, 26, i.e. between 0.5 and 2 times a length of the first and second side portions 24, 26 in a direction perpendicular to the cutter axis 125 and parallel to the first wall portion 120. The curved shape of the first and second side portions 24, 26 further improves the skin comfort of the user.

Figure 5:
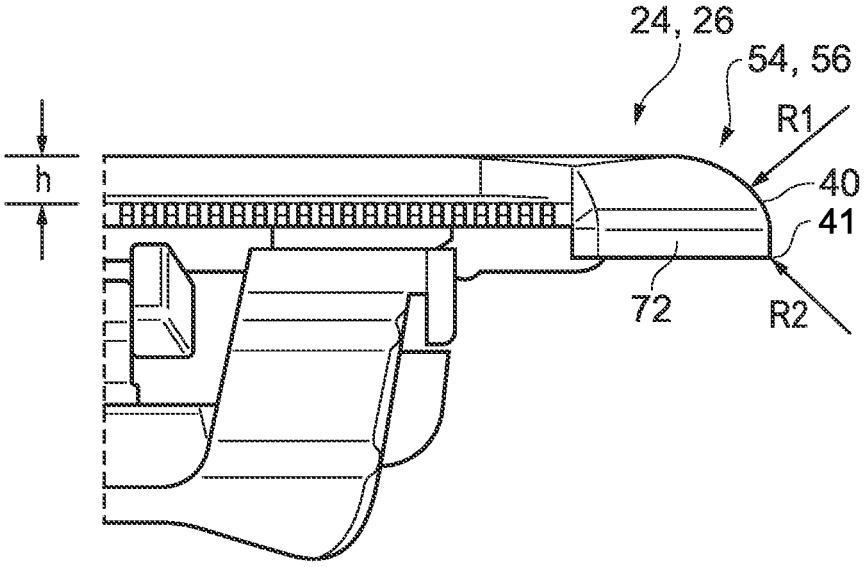
FIG. 5 schematically shows a side view of the attachment when attached to the cutting head as shown in FIG. 4.

Referring to FIG. 5, the convex outer surfaces 54, 56 of the first and second side portions 24, 26 of the attachment 22 are each convex also when seen in a cross-sectional plane perpendicular to the first wall portion 120 and parallel to the cutter axis 125 when the attachment 22 is connected to the cutting head 100. In the embodiment shown in FIG. 5, the convex outer surfaces 54, 56 each comprise a first curved section 40 and a second curved section 41 in said cross-sectional plane perpendicular to the first wall portion 120 and parallel to the cutter axis 125. Said first curved sections 40 of the convex outer surfaces 54, 56 have a radius of curvature R1 in said cross-sectional plane which may be between 1 mm and 5 mm, e.g. 3.6 mm, and the second curved sections 41 of the convex outer surfaces 54, 56 have a radius of curvature R2 in said cross-sectional plane which may be between 0.2 mm and 3 mm, e.g. 0.8 mm. The first and second curved sections 40, 41 of the convex outer surfaces 54, 56 of the first and second side portions 24, 26 further improve the user's skin comfort.

Referring back to FIG. 4 and FIG. 6, the intermediate portion 28 of the attachment 22 has a depth c, seen in a direction perpendicular to the cutter axis 125 and parallel to the first wall portion 120 when the attachment 22 is connected to the cutting head 100, that is less than the depth of the cutting head 100 as defined here before. In the embodiment shown in FIG. 4, the depth c of the intermediate portion 28 is approximately equal to the distance between the bases, i.e. the proximal ends, of the first and second primary cutter teeth 118, 118' of the stationary cutting member 115 in said direction perpendicular to the cutter axis 125 and parallel to the first wall portion 120. The intermediate portion 28 comprises a first continuous longitudinal edge 42 which, when the attachment 22 is connected to the cutting head 100, extends in a direction parallel to the cutter axis 125, and a second continuous longitudinal edge 44 which extends parallel to the first continuous longitudinal edge 42. The depth c of the intermediate portion 28 may also be defined by the distance between the parallel first and second continuous longitudinal edges 42, 44. In the embodiment shown in FIG. 4 with the attachment 22 connected to the cutting head 100, the first continuous longitudinal edge 42 is aligned with and extends adjacent to the bases of the first primary cutter teeth 118 and the second continuous longitudinal edge 44 is aligned with and extends adjacent to the bases of the second primary cutter teeth 118'.

Figure 6:
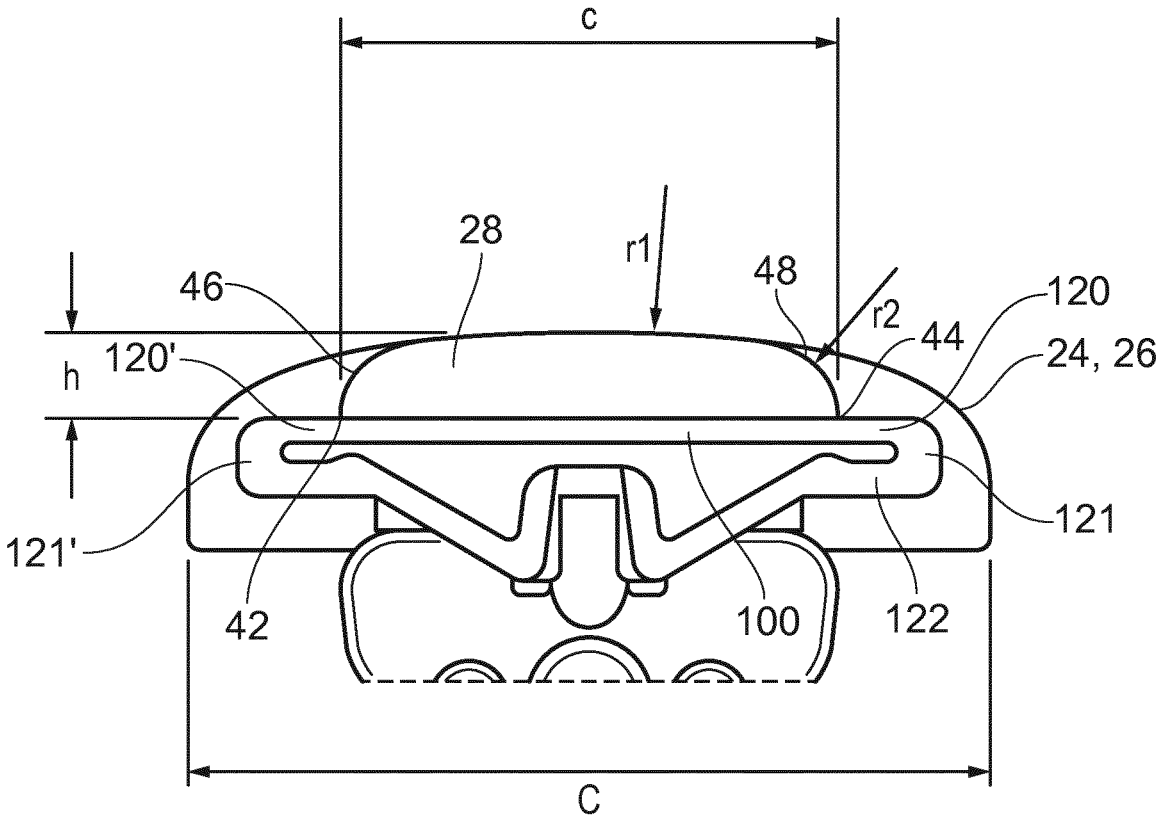
FIG. 6 schematically shows a cross sectional view of the attachment when attached to the cutting head along the line B-B in FIG. 4.

The intermediate portion 28 has an elongate wall comprising the top surface 30 of the attachment 22 and further comprising opposite elongate first and second side surfaces 46, 48. The elongate wall, the top surface 30 and the first and second side surfaces 46, 48 extend parallel to the cutter axis 125 when the attachment 22 is connected to the cutting head 100. The first side surface 46 of the elongate wall extends between the top surface 30 and the first continuous longitudinal edge 42 of the intermediate portion 28, and the second side surface 48 extends between the top surface 30 of the attachment 22 and the second continuous longitudinal edge 44 of the intermediate portion 28. The top surface 30 has a convex profile, seen in a cross-section perpendicular to the cutter axis 125 as shown in FIG. 6. In the embodiment of FIG. 6, the top surface 30 has a radius of curvature r1. The first and second side surfaces 46, 48 each also have a convex profile, seen in the cross-section perpendicular to the cutter axis 125 as shown in FIG. 6. In the embodiment of FIG. 6, the first and second side surfaces 46, 48 each have a radius of curvature r2. In the embodiment shown in FIG. 6, r1 may be between 10 mm and 50 mm, e.g. 21 mm, and r2 may be between 0.2 and 2 times h, e.g. 1.4 mm, wherein h is a maximum height or maximum thickness of the elongate wall of the intermediate portion 28 in a direction perpendicular to the first wall portion 120, as indicated in FIG. 6. In the embodiment shown in FIG. 6, the height h may be between 0.2 mm and 4 mm, e.g. 1.6 mm. The curved geometry of the top surface 30 and the first and second side surfaces 46, 48 of the intermediate portion 28 of the attachment 22 may improve the user's skin comfort.

As shown in FIG. 4, the attachment 22 comprises a first recess 64 which is defined by the first and second side portions 24, 26 and by the intermediate portion 28 and which is bounded by the first continuous longitudinal edge 42 of the intermediate portion 28 and by the curved edges of the first inner wall portions 32, 36 of the first and second side portions 24, 26. The attachment 22 further comprises a second recess 66 which is defined by the first and second side portions 24, 26 and by the intermediate portion 28 and which is bounded by the second continuous longitudinal edge 44 of the intermediate portion 28 and by the curved edges of the second inner wall portions 34, 38 of the first and second side portions 24, 26. The first recess 64 and the second recess 66 are generally elongate and extend in a direction parallel to the cutter axis 125 when the attachment 22 is connected to the cutting head 100. As best shown in FIG. 4, with the attachment 22 attached to the cutting head 100, the first recess 64 exposes the first primary cutter teeth 118 of the cutting head 100 and the second recess 66 exposes the second primary cutter teeth 118' of the cutting head 100. In the embodiment shown in FIG. 4, with the attachment 22 connected to the cutting head 100, the first recess 64 and the second recess 66 each extend in the direction parallel to the cutter axis 125 over a distance which is equal to a majority of the length Z of the first and second cutting zones 106, 108, and the first recess 64 and the second recess 66 are each continuous, i.e. non-interrupted, in said direction parallel to the cutter axis 125 over said distance. This means that the first and second primary cutter teeth 118, 118' are exposed by the first and second recesses 64, 66 over a majority of the length Z of the first and second cutting zones 106, 108, i.e. the first and second cutting zones 106, 108 are exposed continuously and uninterrupted in said direction parallel to the cutter axis 125 over a majority of their length Z. In the embodiment shown in FIG. 4, the first and second recesses 64, 66 are continuous over a distance of at least 90% of the length Z of the first and second cutting zones 106, 108. However, it should be appreciated that, in alternative embodiments, the first and second recesses 64, 66 may be continuous and non-interrupted in the direction parallel to the cutter axis 125 over a smaller distance than 90% of the length Z, and said distance may be different for the first and second recesses 64, 66. In general, according to the invention, when the attachment 22 is connected to the cutting head 100 the first and second recesses 64, 66 extend in the direction parallel to the cutter axis 125 and are non-interrupted in said direction parallel to the cutter axis 125 over a distance of at least 50% of the length of, respectively, the first and second cutting zones 106, 108.

In use, with the attachment 22 connected to the cutting head 100, the top surface 30 of the intermediate portion 28 of the attachment 22 contacts the skin first and pushes the skin down and away from the areas in front of the attachment 22. The profiled first and second side surfaces 46, 48 of the intermediate portion 28 also pull the skin down and away from the area immediately in front of and around the first and second cutting zones 106, 108. The skin is therefore not exposed to the locally high contact forces that may occur at the primary cutter teeth 118, 118'. Therefore, skin abrasions, skin cuts, pain and/or skin irritation are reduced or eliminated. The attachment 22 can be described as "toothless" since no comb teeth are provided. This is in contrast with a conventional clip-on comb attachment, for example, which comprises a plurality of comb teeth which are arranged in a direction perpendicular to the cutter axis and which overlap the cutter teeth. The inventors have found that, in particular for a cutting head of the type described herein, with a stationary cutting member comprising a first wall portion and a second wall portion which are mutually connected by means of a bent intermediate wall portion wherein a plurality of primary cutter teeth having a bent cross-section is provided, and with a movable cutting member which is movable in a reciprocating manner in a guiding space enclosed by the first and second wall portions of the stationary cutting member and which comprises a plurality of secondary cutter teeth for co-operation with the primary cutter teeth of the stationary cutting member, such a "toothless" attachment 22 can provide a favourable combination of skin comfort and shaving or trimming performance as a result of the combined skin-protecting effects of the attachment 22 and the arrangement of the moving secondary cutter teeth of the movable cutting member within and enclosed by the bent intermediate wall portion and the bent primary cutter teeth of the stationary cutting member.

The attachment 22 may be integrally formed from a single material. The attachment 22 may be formed from a low friction material, such that it produces very little drag or friction when it is moved across the surface of the skin. For example, the attachment 22 may be made from at least one of a low friction rubber, synthetic rubber, silicone, plastics material, thermoplastic material (which may be formed by injection-moulding), ceramic, glass and metal.

Further, the attachment 22 is arranged to be connectable to and detachable from the cutting head 100, such that it can be easily attached and removed by a user depending on the area of skin on which the hair cutting device is to be used. In a preferred embodiment, the attachment 22 is connectable to the cutting head 100 by means of a releasable snap-on connector. As schematically shown in FIG. 5, such a releasable snap-on connector may be formed by elastically deformable edge portions 72, which are formed on the first and second side portions 24, 26 of the attachment 22 and may be clamped around the first and second sides 112, 114 of the stationary cutting member 115.

Although in the embodiments shown in the Figures the cutting head 100 has first and second cutting zones 106, 108, the invention can also be applied to hair cutting systems having a cutting head with a single cutting zone. In such embodiments, the attachment may have first and second side portions which protrude relative to the primary cutter teeth of only said single cutting zone, and the attachment may have only a single recess defined by the first and second side portions and by the intermediate portion and exposing the primary cutter teeth of said single cutting zone.

It will be appreciated by those skilled in the art that, although the invention has been described by way of example with reference to one or more examples, it is not limited to the disclosed examples and alternative examples may be constructed without departing from the scope of the invention as defined by the appended claims.

The invention claimed is:

1. A hair cutting system comprising a cutting head and an attachment which is releasably connectable to the cutting head, the cutting head comprising:

a stationary cutting member comprising a first wall portion, a second wall portion, and a bent intermediate wall portion connecting the first and second wall portions, wherein a plurality of primary cutter teeth each having a bent cross-section is provided on the bent intermediate wall portion; and a movable cutting member moveable in a reciprocating manner along a cutter axis in a guiding space enclosed by the first and second wall portions of the stationary cutting member, wherein the movable cutting member comprises a plurality of secondary cutter teeth for co-operation with the primary cutter teeth, wherein the first wall portion and the second wall portion each have an inner surface and an outer surface, wherein the inner surfaces of the first and second wall portions face each other, and wherein the outer surface of the first wall portion is part of a skin facing surface of the cutting head which faces a user's skin during operation, wherein the plurality of primary cutter teeth define a cutting zone of the cutting head extending parallel to the cutter axis and having a length, and wherein the stationary cutting member further comprises first and second sides spaced apart in a direction parallel to the cutter axis; and the attachment comprising:

first and second side portions configured to cover, respectively, the first and second sides of the stationary cutting member when the attachment is connected to the cutting head; and an intermediate portion interconnecting the first and second side portions of the attachment and configured to cover the outer surface of the first wall portion of the stationary cutting member when the attachment is connected to the cutting head, wherein, when the attachment is connected to the cutting head:

the first and second side portions of the attachment protrude relative to the primary cutter teeth in a direction perpendicular to the cutter axis and parallel to the first wall portion; and the first and second side portions of the attachment and the intermediate portion define opposite recesses respectively exposing the primary cutter teeth, each recess extending in the direction parallel to the cutter axis and being non-interrupted in the direction parallel to the cutter axis over a distance of at least 50% of the length of the cutting zone, wherein the first and second side portions of the attachment each has a convex outer surface, seen in a cross-section parallel to the first wall portion of the stationary cutting member, extending outwardly from the intermediate portion past the first and second sides of the stationary cutting member in opposite directions parallel to the cutter axis when the attachment is connected to the cutting head, and wherein each recess is bounded by a continuous longitudinal edge of the intermediate portion which, when the attachment is on the first wall portion of the stationary cutting member, extends in the direction parallel to the cuter axis.

2. The hair cutting system according to claim 1, wherein each recess is non-interrupted over a distance of at least 90% of the length of the cutting zone.

3. The hair cutting system according to claim 1, wherein the intermediate portion comprises an elongate wall which, when the attachment is connected to the cutting head, extends in the direction parallel to the cutter axis and has a convex outer surface seen in a cross-section perpendicular to the cutter axis.

4. The hair cutting system according to claim 3, wherein the convex outer surface of the elongate wall has a radius of curvature of between 10 mm and 50 mm in said cross-section perpendicular to the cutter axis.

5. The hair cutting system according to claim 1, wherein, when the attachment is connected to the cutting head, the first and second side portions protrude relative to the primary cutter teeth in the direction perpendicular to the cutter axis and parallel to the first wall portion by a distance of between 0.5 mm and 3 mm.

6. The hair cutting system according to claim 1, wherein the convex outer surfaces of the first and second side portions each have a radius of curvature in the cross-section parallel to the first wall portion which is between 0.5 and 2 times a length of the respective side portion in the direction perpendicular to the cutter axis and parallel to the first wall portion.

7. The hair cutting system according to claim 1, wherein the first and second side portions of the attachment each has the convex outer surface, seen in a cross-section perpendicular to the first wall portion and a cross-section parallel to the cutter axis.

8. The hair cutting system according to claim 7, wherein the convex outer surfaces of the first and second side portions each has a radius of curvature in said cross-section perpendicular to the first wall portion and said cross-section parallel to the cutter axis which is between 1 mm and 5 mm.

9. The hair cutting system according to claim 1, wherein the attachment is connectable to the cutting head by means of a releasable snap-on connector.

10. The hair cutting system according to claim 1, wherein the attachment is toothless.

11. The hair cutting system according to claim 1, wherein the attachment further comprises:

a releasable snap-on connector comprising elastically deformable edge portions formed on the first and second side portions of the attachment and configured to clamp around the first and second sides of the stationary cutting member.

12. A hair cutting system comprising a cutting head and an attachment which is releasably connectable to the cutting head, the cutting head comprising:

a stationary cutting member comprising:

a first wall portion, a second wall portion, and a bent intermediate wall portion connecting the first and second wall portions, wherein a plurality of primary cutter teeth each having a bent cross-section is provided on the bent intermediate wall portion;

a third wall portion, a fourth wall portion, and a bent further intermediate wall portion connecting the third and fourth wall portions, wherein a plurality of further primary cutter teeth each having a bent cross-section is provided on the bent further intermediate wall portion; and first and second sides spaced apart in a direction parallel to a cutter axis, and opposite third and fourth sides spaced apart in a direction perpendicular to the cutter axis, wherein the plurality of primary cutter teeth and the plurality of further primary cutter teeth are respectively provided on the opposite third and fourth sides;

a movable cutting member moveable in a reciprocating manner along the cutter axis in a guiding space enclosed by the first and second wall portions and the third and fourth wall portions, wherein the movable cutting member comprises a plurality of secondary cutter teeth for co-operation with the primary cutter teeth and a plurality of further secondary cutter teeth for co-operation with the further primary cutter teeth, wherein the first wall portion and the second wall portion each has an inner surface and an outer surface, wherein the inner surfaces of the first and second wall portions face each other, and wherein the outer surface of the first wall portion is part of a skin facing surface of the cutting head which faces a user's skin during operation, wherein the third wall portion and the fourth wall portion each has an inner surface and an outer surface, wherein the inner surfaces of the third and fourth wall portions face each other, and wherein the outer surface of the third wall portion is part of the skin facing surface of the cutting heads, wherein the plurality of primary cutter teeth define a cutting zone of the cutting head extending parallel to the cutter axis and having a length, wherein the plurality of further primary cutter teeth define a further cutting zone of the cutting head extending parallel to the cutter axis and having a further length; and the attachment comprising:

first and second side portions configured to cover, respectively, the first and second sides of the stationary cutting member when the attachment is connected to the cutting head; and an intermediate portion interconnecting the first and second side portions of the attachment, and is configured to cover the outer surface of each of the first wall portion and the third wall portion of the stationary cutting member when the attachment is connected to the cutting head; and wherein, when the attachment is connected to the cutting head:

the first and second side portions of the attachment protrude relative to the primary cutter teeth and the further primary cutter teeth in the direction perpendicular to the cutter axis and parallel to the first wall portion and the third wall portion of the stationary cutting member; and the first and second side portions of the attachment and the intermediate portion of the attachment define a recess exposing the primary cutter teeth and a further recess exposing the further primary cutter teeth, each of the recess and the further recess extending in the direction parallel to the cutter axis and being non-interrupted in the direction parallel to the cutter axis over a distance of at least 50% of the length of the cutting zone and the further cutting zone respectively, and wherein the first and second side portions of the attachment each has a convex outer surface, seen in a cross-section parallel to the first wall portion of the stationary cutting member when the attachment is connected to the cutting head, and wherein each of the recess and the further recess is bounded by a continuous longitudinal edge of the intermediate portion which, when the attachment is on the first and third wall portions of the stationary cutting member, extends in the direction parallel to the cuter axis.

13. The hair cutting system according to claim 12, wherein, when the attachment is connected to the cutting head, the first and second side portions of the attachment protrude relative to the primary cutter teeth by a first distance and protrude relative to the further primary cutter teeth by a second distance different from the first distance.

14. A system including an attachment releasably connected to a cutting head of a hair cutting device, the cutting head comprising:

a stationary cutting member comprising a first wall portion, a second wall portion, and a bent intermediate wall portion connecting the first and second wall portions, wherein a plurality of primary cutter teeth each having a bent cross-section is provided on the bent intermediate wall portion; and a movable cutting member moveable in a reciprocating manner along a cutter axis in a guiding space enclosed by the first and second wall portions of the stationary cutting member, wherein the movable cutting member comprises a plurality of secondary cutter teeth for co-operation with the primary cutter teeth, wherein the first wall portion and the second wall portion each has an inner surface and an outer surface, wherein the inner surfaces of the first and second wall portions face each other, and wherein the outer surface of the first wall portion is part of a skin facing surface of the cutting head which faces a user's skin during operation, wherein the plurality of primary cutter teeth define a cutting zone of the cutting head extending parallel to the cutter axis and having a lengths, and wherein the stationary cutting member has opposite first and second sides spaced apart in a direction parallel to the cutter axis; and the attachment comprising:

first and second side portions configured to cover, respectively, the first and second sides of the stationary cutting member; and an intermediate portion interconnecting the first and second side portions of the attachment and configured to cover the outer surface of the first wall portion of the stationary cutting member; and wherein the first and second side portions of the attachment protrude relative to the primary cutter teeth in a direction perpendicular to the cutter axis and parallel to the first wall portion, and wherein the first and second side portions of the attachment and the intermediate portion define opposite recesses respectively exposing the primary cutter teeth, each recess extending in the direction parallel to the cutter axis and being non-interrupted in the direction parallel to the cutter axis over a distance of at least 50% of the length of the cutting zone, wherein the first and second side portions of the attachment each has a convex outer surface, seen in a cross-section parallel to the first wall portion of the stationary cutting member and parallel to the cutter axis, extending outwardly from the intermediate portion past the first and second sides of the stationary cutting member in opposite directions parallel to the cutter axis, and wherein each recess is bounded by a continuous longitudinal edge of the intermediate portion which, when the attachment is on the first wall portion of the stationary cutting member, extends in the direction parallel to the cuter axis.

15. The system according to claim 14, further comprising:

a releasable snap-on connector comprising elastically deformable edge portions formed on the first and second side portions of the attachment and configured to clamp around the first and second sides of the stationary cutting member.

16. The system according to claim 14, wherein the first and second side portions each has the convex outer surface, seen in a cross-section perpendicular to the first wall portion and the cross-section parallel to the cutter axis.

17. The system according to claim 16, wherein the convex outer surfaces of the first and second side portions each has a radius of curvature in the cross-section perpendicular to the first wall portion and the cross-section parallel to the cutter axis which is between 1 mm and 5 mm.

* * * * *